US005388743A

United States Patent [19]

Silagy

[11] Patent Number: 5,388,743

[45] Date of Patent: Feb. 14, 1995

[54] SHOULDER PAD FOR DECORATIVE GUITAR STRAP

[76] Inventor: Howard Silagy, 100A Tec St., Hicksville, N.Y. 11801

[21] Appl. No.: 274,164

[22] Filed: Jul. 14, 1994

[51] Int. Cl.[6] ..... A41F 15/02; A45F 3/12

[52] U.S. Cl. ..... 224/264; 224/910; 2/268; D3/287; D3/327; D17/99; 84/327

[58] Field of Search ..... 224/264, 910; 2/268, 2/450; 450/86; D3/287, 327, 232, 215; D17/9, 13, 20, 99; 150/107; 84/327; 294/149, 150, 151

[56] References Cited

U.S. PATENT DOCUMENTS

| | | | |
|---|---|---|---|
| D. 102,023 | 11/1936 | Adams | D3/327 |
| D. 282,601 | 2/1986 | Bomes et al. | D3/287 |
| D. 298,386 | 11/1988 | Hirahara | 224/264 |
| D. 300,388 | 3/1989 | Sears | D3/287 |
| D. 341,026 | 11/1993 | Banker | D3/287 |
| 640,124 | 12/1899 | Gaddis | 2/268 |
| 4,575,874 | 3/1986 | Johnson | 2/268 |

*Primary Examiner*—Henry J. Recla
*Assistant Examiner*—Gregory M. Vidovich

[57] ABSTRACT

A shoulder pad for a guitar strap characterized by a noteworthy decorative pattern, wherein the shoulder pad uses a see-through netting cover for the strap slidably disposed beneath same such that the strap decorative pattern always is in visual display.

2 Claims, 2 Drawing Sheets

SHOULDER PAD FOR DECORATIVE GUITAR STRAP

The present invention relates generally to an improved shoulder pad for a guitar strap, and more particularly to improvements which not only contribute to comfort of the guitarist which is the extent of the current practice, but which embodies an enhanced appearance for the cooperating guitar strap and pad combination.

EXAMPLES OF THE PRIOR ART

Pads of comfort-enhancing construction material, such as neoprene, are in common use in an interposed position between a weight-supporting strap whether for a guitar, golf bag, or the like, and the shoulder of the user, to negate the discomfort of the supported weight.

In addition to the prior art shoulder pad depicted in FIG. 1 of this application of U.S. Pat. No. 3,323,698 for "Guitar Strap" issued to Sottile on Jul. 15, 1966 which masks the strap and thus has no significant impact on its display, there are other patented shoulder straps which improve on the comfort function of pad, but similarly have no appearance-enhancing function.

The above is demonstrated by U.S. Pat. No. 1,631,694 for "Shoulder Pad" not specified for a guitar strap, but generally "for the protection of the shoulder when carrying objects by means of a strap passing over the shoulder" (left column, page 1), issued to Rick on Jun. 7, 1927. In Rick, the strap 9 is threaded through leather loops 5, 6 and 7 and presumably slidable beneath these loops. Although visible between the loops 5, 6 and 7, the construction material of the strap 9 undoubtedly is confined to that which is abrasion-resistant, probably leather, in order to minimize abrading of the surface of the strap by the edges defining the loops.

Broadly, it is an object of the present invention to provide a guitar strap shoulder pad characterized by imparting a noteworthy display function when in use with the strap assembled to it, thereby overcoming the foregoing and other shortcomings of the prior art.

More particularly, it is an object to so embody the within shoulder pad to highlight and favorably display the guitar strap, that a guitar strap with a decorative surface pattern is warranted for use therewith, all to the end of providing a combination shoulder pad and guitar strap of noteworthy utility.

The description of the invention which follows, together with the accompanying drawings should not be construed as limiting the invention to the example shown and described, because those skilled in the art to which this invention appertains will be able to devise other forms thereof within the ambit of the appended claims.

Figure 1:
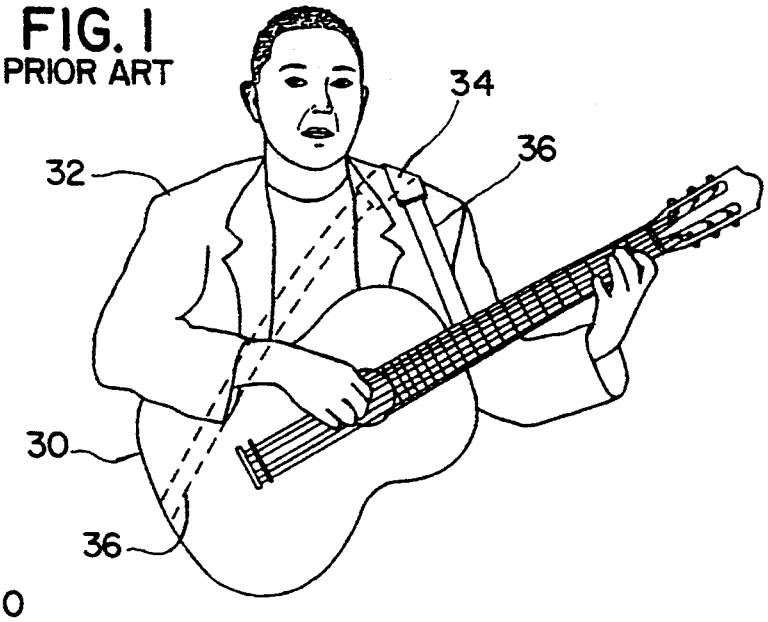
FIG. 1 PRIOR ART
FIG. 1 is a perspective view of a guitarist using a prior art shoulder pad that contributes to comfort but not favorably affecting appearance.

As shown in FIG. 1, a guitarist 10 will typically support a guitar 12 at opposite ends of a strap 14 looped over a shoulder, as at 16, and use a neoprene or rubber shoulder pad 18 to cushion against the guitar weight and the forces generated by the strumming of the guitar. As illustrated, the prior art pad 18 receives the strap 14 under an opaque cover 18A to partake of sliding movements, as noted by the arrow 20, to accommodate the guitar positioning preference of the guitarist 10.

Underlying the present invention is the recognition that a guitar strap typically of web construction material for strength, also in the weaving process is embodied with a highly decorative pattern, and that the shoulder pad should enhance, rather than mask, said strap decorative pattern.

Figure 5:
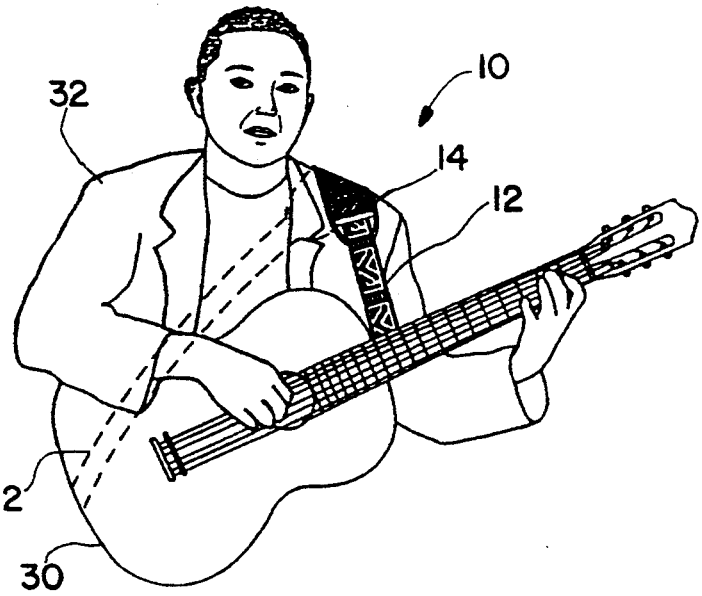
FIG. 5 is a perspective view similar to FIG. 1, but of the inventive shoulder pad hereof illustrating the resulting appearance enhancement of the decorative shoulder strap.

As shown in FIG. 5 intentionally drawn similar to FIG. 1 for comparison therewith, it can be noted that in use is a guitar strap 30 of web construction material 30A characterized by a highly decorative pattern 30B embodied by well understood weaving techniques in at least the outwardly facing surface of the belt. The strap decorative pattern 30B is in noticeable display in its assembled relation to the shoulder pad 32, as illustrated in FIG. 5 and as particularly noted at the shoulder loop location 34.

Figure 2:
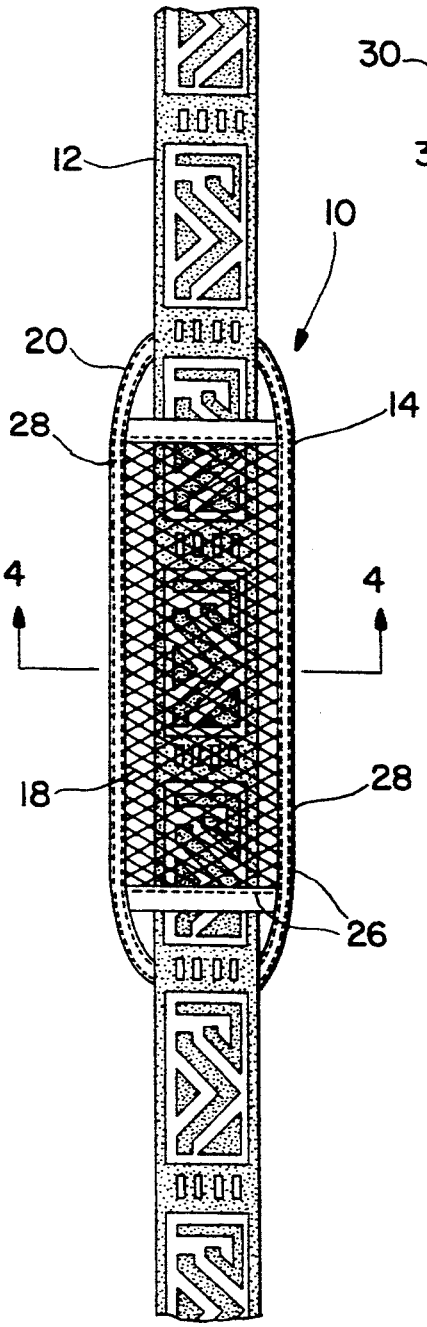
FIG. 2 is a partial plan view, on an enlarged scale, of a decorative guitar strap and the within inventive appearance enhancing shoulder pad.
Figure 4:
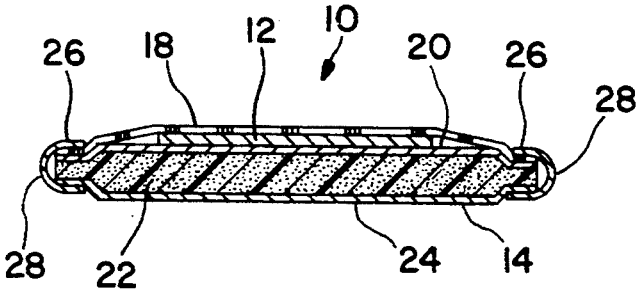
FIG. 4 is a cross sectional view of the FIG. 2 assembly.
Figure 3:
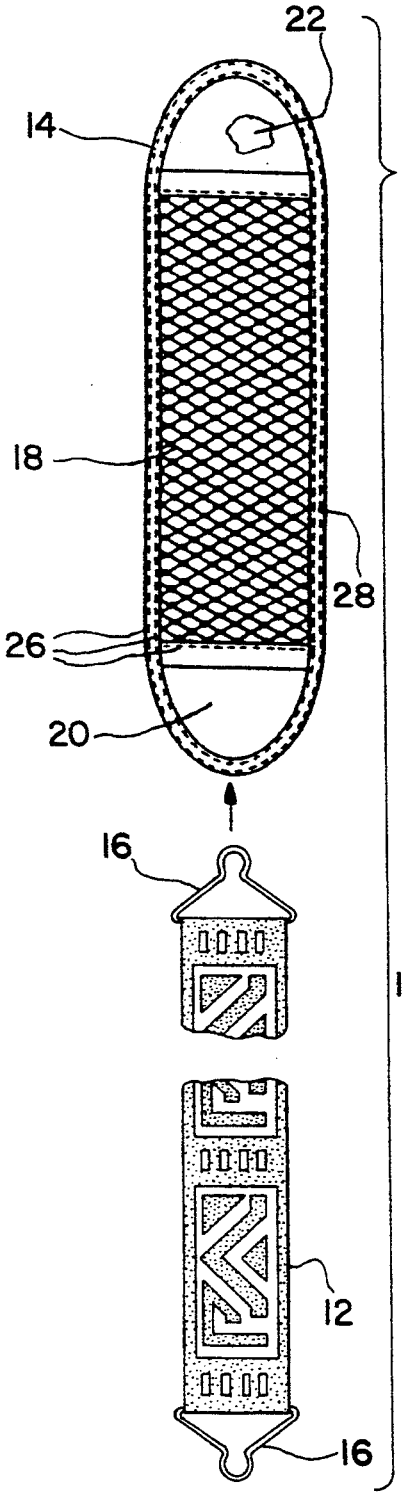
FIG. 3 is an unassembled view of the guitar strap and shoulder pad incident to their assembled condition of FIG. 2.

Eschewing use of an opaque pad cover according to the prior art practice of FIG. 1, and as best shown in FIGS. 2, 3 and 4, the within inventive shoulder pad 32 has a substantially rectangular neoprene base 32A with rounded front and rear extensions 33 and a strip 32B of net construction material in covering relation over the base 32A, which net is unattached except along coextensive edges beneath a sewn edge binding 36, as typically used in providing a finished edge appearance. Thus, appropriately connected to guitar-engaging clips 38 and 40, strap 30 is prepared for use, as best shown in FIG. 3, by being threaded in the direction 42 through a passageway 44 formed between the net strip 32B and the medial portion of the top of base 32A, thereby resulting in the assembled condition depicted in FIG. 2. In the FIG. 2 condition, the strap decorative pattern 30B is displayed through the interstices 46 of the netting strip 32B to contribute to an enhanced appearance of the shoulder pad 32.

While the guitar strap maintained in prominent display as herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. A shoulder pad for a guitar strap of web construction material characterized by a decorative pattern displayed therealong, said shoulder pad comprising a rectangular shaped base of neoprene having opposing short and long sides and having in use an interposed position over a user's shoulder and beneath said decorative strap looped over said shoulder, and a cover in the form of a strip of net construction material attached only along opposing edges of said long sides of said base so as to bound between said opposing edges of said long sides an open-ended passageway for tracking movement therethrough of said decorative strap, whereby said decorative strap remains in visible display through said net cover to contribute to an enhanced appearance of said shoulder pad.

2. A shoulder pad for an object-supporting strap of web construction material characterized by a decorative pattern displayed therealong, said shoulder pad comprising a rectangular shaped base of neoprene having opposing short and long sides and having in use an interposed position over a user's shoulder and beneath said decorative strap looped over said shoulder, and a cover in the form of a strip of net construction material attached only along opposing edges of said long side of said base so as to bound between said opposing edges of said long sides an open-ended passageway for tracking movement therethrough of said decorative strap, whereby said decorative strap remains in visible display through said net cover to contribute to an enhanced appearance of said shoulder pad.

* * * * *